US005360121A

United States Patent [19]

Sothman

[11] Patent Number: 5,360,121

[45] Date of Patent: Nov. 1, 1994

[54] SLOTTED DISPLAY WALL PANEL

[75] Inventor: Donald J. Sothman, Menomonee Falls, Wis.

[73] Assignee: Commerical and Architectural Products, Inc., Dover, Ohio

[21] Appl. No.: 927,142

[22] Filed: Aug. 7, 1992

[51] Int. Cl.[5] ..... A47F 5/00

[52] U.S. Cl. ..... 211/87; 211/94

[58] Field of Search ..... 211/87, 94, 189, 90

[56] References Cited

U.S. PATENT DOCUMENTS

| | | | |
|---|---|---|---|
| 3,235,218 | 2/1966 | Graham | 248/225 |
| 4,434,900 | 3/1984 | Cook | 211/189 |
| 4,591,058 | 5/1986 | Amstutz et al. | 211/87 X |
| 4,607,753 | 8/1986 | Radek | 211/87 |
| 4,615,448 | 10/1986 | Johnstonbaugh | 211/94 |
| 4,629,076 | 12/1986 | Amstutz et al. | 211/94 |
| 4,844,266 | 7/1989 | Small et al. | 211/94 X |
| 4,944,416 | 7/1990 | Petersen et al. | 211/87 |
| 5,101,989 | 4/1992 | Jones | 211/94 |
| 5,109,993 | 5/1992 | Hutchison | 211/87 |

*Primary Examiner*—Alvin C. Chin-Shue
*Assistant Examiner*—Sarah A. Lechok
*Attorney, Agent, or Firm*—Pearne, Gordon, McCoy & Granger

[57] ABSTRACT

A slotted display wall provides a modified "T" shaped slot having a throat open to the front face of the panel and a vertically extending opening inwardly spaced from said throat, said opening including opposed angled walls extending in both directions from said throat to end extremities, the angled walls being angled toward the back face of the panel from said throat to the extremities, said opening also including end walls joining the extremities of the angled walls and extending to a rearward face spaced from the back face of the panel. The opening provides a relatively deep dimension adjacent to the throat and increasing material thickness between the angled walls and the front face as the angled walls extend from the throat towards their extremities. This permits conventional cantilever brackets to be installed through the slots and provide upper mounting portions which engage the angled walls at a point substantially spaced from the throat where greater material thickness exists. The panels may be formed substantially thinner than prior ¾ inch thick display wall panels.

10 Claims, 2 Drawing Sheets

SLOTTED DISPLAY WALL PANEL

BACKGROUND OF THE INVENTION

This invention relates to an improvement in display panels providing a plurality of horizontal generally T-shaped grooves. These grooves are shaped to allow the insertion of cantilever mounted brackets used to support various articles.

PRIOR ART

Display wall panels of the general type involved in this invention are well known. Generally they are about $\frac{3}{4}$ of an inch thick and are formed with horizontally extending modified "T" shaped slots opened to the front face of the panel. These slots are constructed to permit the installation of cantilever brackets at substantially any location along the length of the slots. The brackets are shaped to support and display various types of articles.

Examples of such display wall panels are illustrated and described in the U.S. Pat. Nos. 3,235,218; 4,434,900; 4,607,753; 4,615,448; 4,629,076; 4,944,416; and 5,109,993. In some cases, metal inserts are installed within the slots to increase the strength so that heavier loads can be supported on the brackets. In other instances, the slots are unlined, and the strength of the panel material itself and the shape and size of the brackets determine the load supporting capacity of the bracket.

There has been a tendency to standardize the display panels so that a given bracket can be utilized with substantially any of the available slotted display walls. Further, the dimensions of the T-shaped slots have generally been selected to permit the use of commonly available brackets initially intended for use with peg board.

In a typical display wall, the panel is $\frac{3}{4}$ of an inch thick. The modified "T" shaped slot provides a throat opening in the front face of the panel which is about $\frac{3}{8}$ of an inch wide and extends with diverging walls inwardly from the outer end of the throat for about $\frac{1}{4}$ of an inch. The cross portion of the slot which extends vertically and forms the cross portion of the T-shape, provides parallel and opposed forward and rearward surfaces spaced $\frac{1}{4}$ of an inch apart. The rearward surface of the slot is parallel to the back face of the panel and is spaced there from $\frac{1}{4}$ of an inch.

Typical brackets provide a mounting portion having a rearward face engageable with the face of the display panel below the associated slot, an offset or lateral portion having an underside engageable with the lower wall of the throat adjacent to the outer edge thereof and an upwardly extending portion which fits within the slot and engages the vertically extending forward wall of the T-shaped slot at a location above the throat portion of the slot. Extending forwardly from the mounting portion is the cantilever portion of the bracket on which various types of articles are supported.

Once installed, the mounting portion is supported vertically by the engagement of the rearwardly extending or offset portion and the lower wall of the throat. Force moments applied to the cantilever portion by the supported articles are resisted by a force couple resulting from the cooperation of the lower mounting portion which engages the forward face of the panel and the upper end portion which engages the forward wall of the inner slot which extends parallel to both the forward and rearward faces of the panel. Since this forward wall portion of the inner slot extends parallel to both the front and back faces of the panel and is spaced from the front face by $\frac{1}{4}$ of an inch in a typical panel, the offset provided in the bracket is designed to laterally space the rearward face of the lower portion of the mounting portion and the forward face of the upper portion $\frac{1}{4}$ of an inch.

The throat itself is formed with a relatively narrow opening adjacent to the forward face such as $\frac{3}{8}$ of an inch but extends back with diverging walls to facilitate the insertion of the mounting portion of the bracket. These diverging walls, however, do not preform any supporting function once the bracket is installed.

SUMMARY OF THE INVENTION

The present invention is directed to a novel and improved slotted display wall panel which is substantially thinner than the conventional $\frac{3}{4}$ inch thick panels and can be used with substantially all of the existing cantilever brackets previously available for the $\frac{3}{4}$ inch thick panels. This thinner panel, approximately $\frac{1}{2}$ inch thick, is intended for use where lower support load ratings are required. With this panel, substantial savings in costs of material are achieved, and since the weight of the panel is substantially less than the corresponding conventional prior art panel, shipping costs are also drastically decreased.

In order to minimize the reduction in strength resulting from the reduced thickness of the panel, while still permitting the use of conventional bracket with the panel, the shape of the modified "T" shaped slot is changed. In the illustrated embodiment, opposed inclined walls extend from the throat to the ends of the slot. By providing inclined walls, sufficient clearance is provided at the throat to allow the insertion and removal of substantially all of presently available brackets. However, the end of the upper portion of the bracket extends to a location along the inclined wall which is substantially spaced from the throat. At such location, thicker material exists so that substantial strength remains to support loads carried by the brackets.

Also, the spacing between the back panel surface and the inner wall of the slot is reduced. Such reduction does not reduce the load rating of the panel.

Still further, the thickness of the material forming the panel at the location where the upper extremity of the upper mounting portion of the bracket is slightly less than $\frac{1}{4}$ of an inch. Therefore, the lower mounting portion engages the front face of the panel only at a point spaced from the associated throat. Therefore, the moment arm of the force couple resisting the load is increased, and strength is improved.

These and other aspects of this invention are illustrated in the accompanied drawings and are described in detail in the following specification.

DETAILED DESCRIPTION OF THE DRAWINGS

Figure 1:
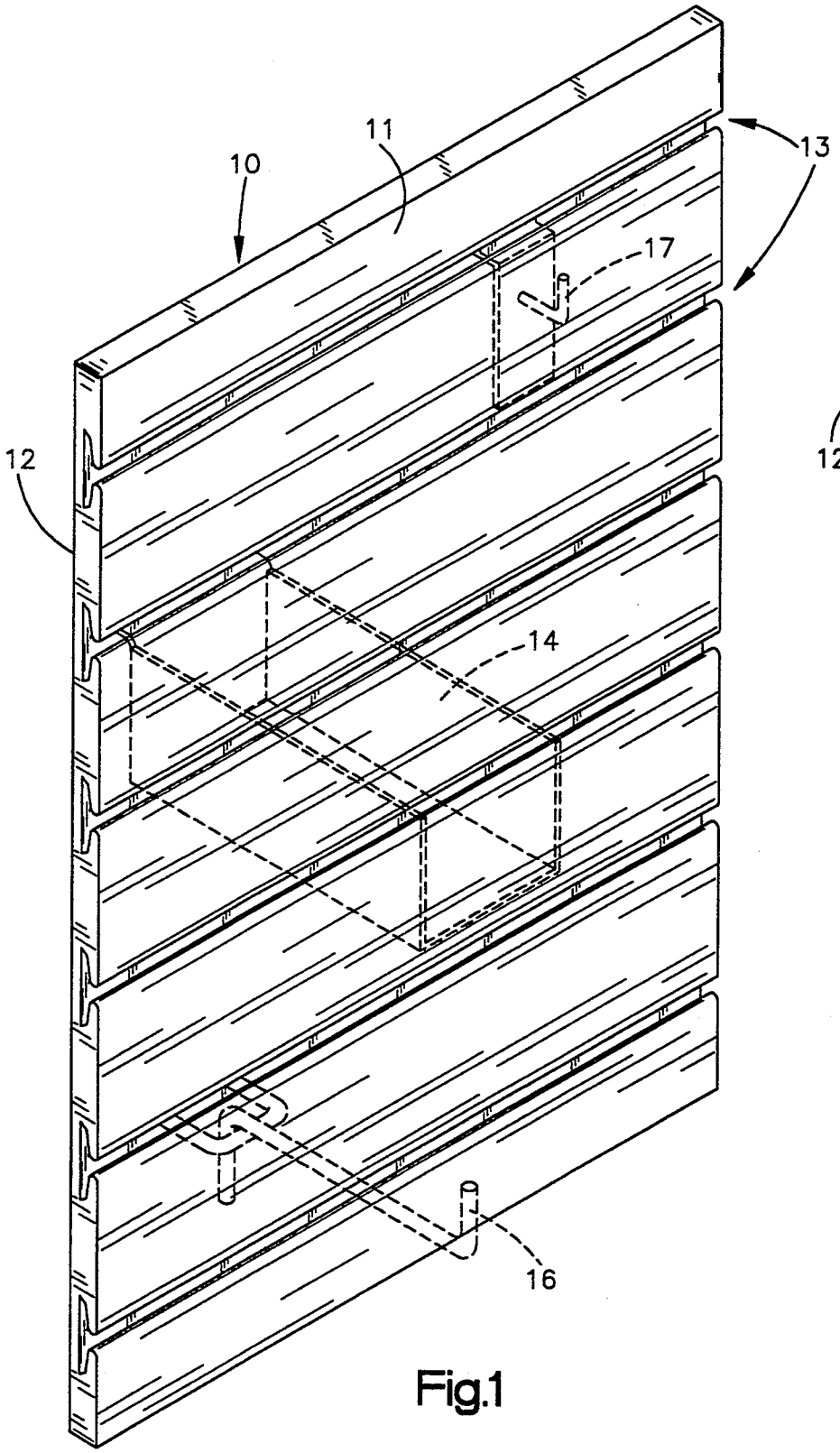
FIG. 1 is a perspective view of a slotted display wall panel in accordance with the present invention, with various types of brackets (illustrated in phantom) installed thereon.
Figure 2:
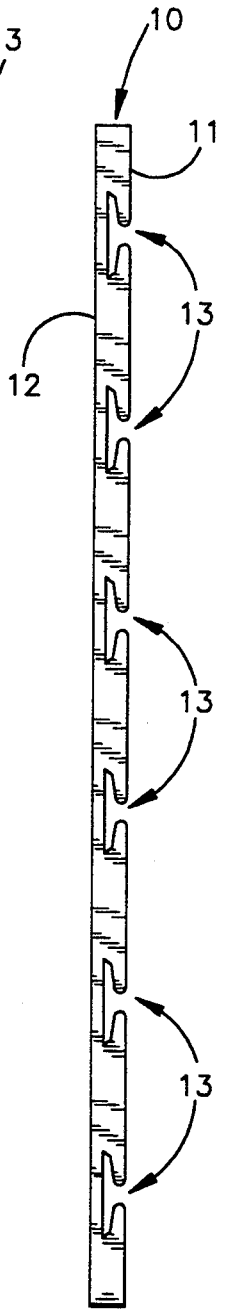
FIG. 2 is an end view of the panel illustrating the general shape of the slots formed in the panel.

FIG. 1 illustrates a portion of a typical slotted display wall panel 10, in accordance with the present invention. The panel 10 is supported in a vertical position by any suitable means (not illustrated). The panel has a planar front face 11 and a planar opposed and parallel rearward face 12. A plurality of modified "T" shaped horizontally extending slots 13 are open to the front face 11. Typically, there are a plurality of such slots formed in the panel at locations vertically spaced from the adjacent slots so that brackets can be installed on the panel at substantially any desired location. Typically, the panels are formed of medium density fiberwood.

In FIG. 1, three different forms of brackets 14, 16 and 17 are illustrated in phantom and installed in three different slots 13. These brackets are cantilever-type brackets on which a variety of articles can be supported. Typically, the articles supported by the bracket are displayed in an accessible manner so that a customer may remove desired articles for purchase.

Figure 5:
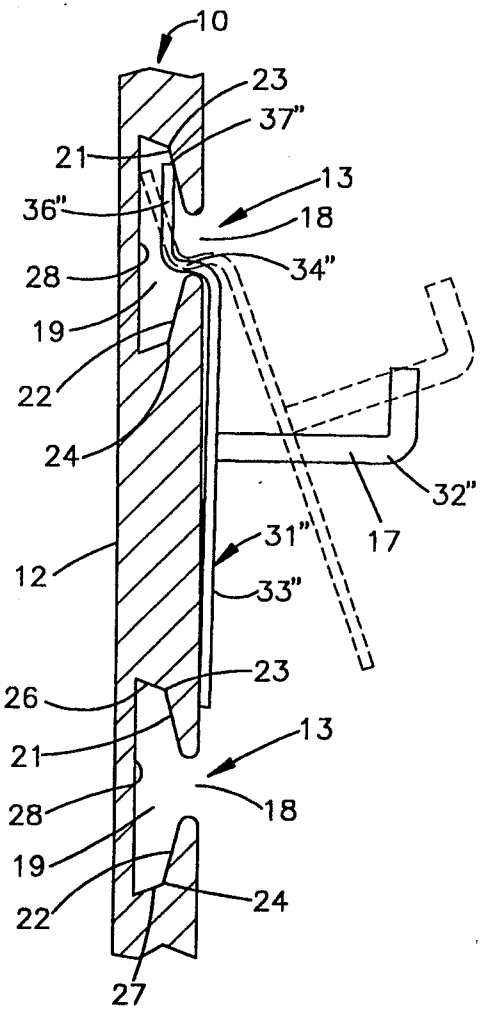
FIG. 5 is a view similar to FIGS. 3 and 4 but illustrating the installation of still another type of bracket.
Figure 4:
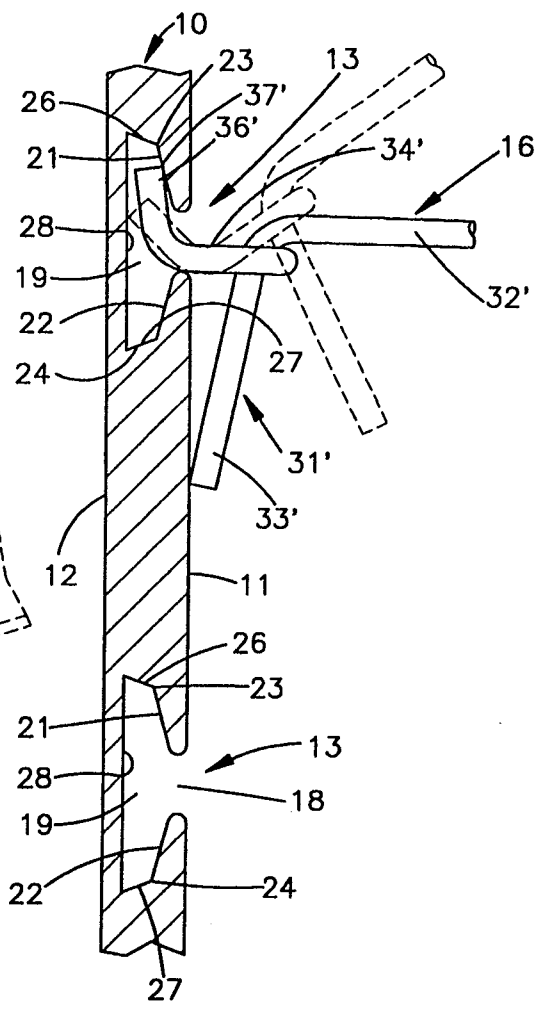
FIG. 4 is similar to FIG. 3 but illustrates the installation of a typical peg board bracket.
Figure 3:
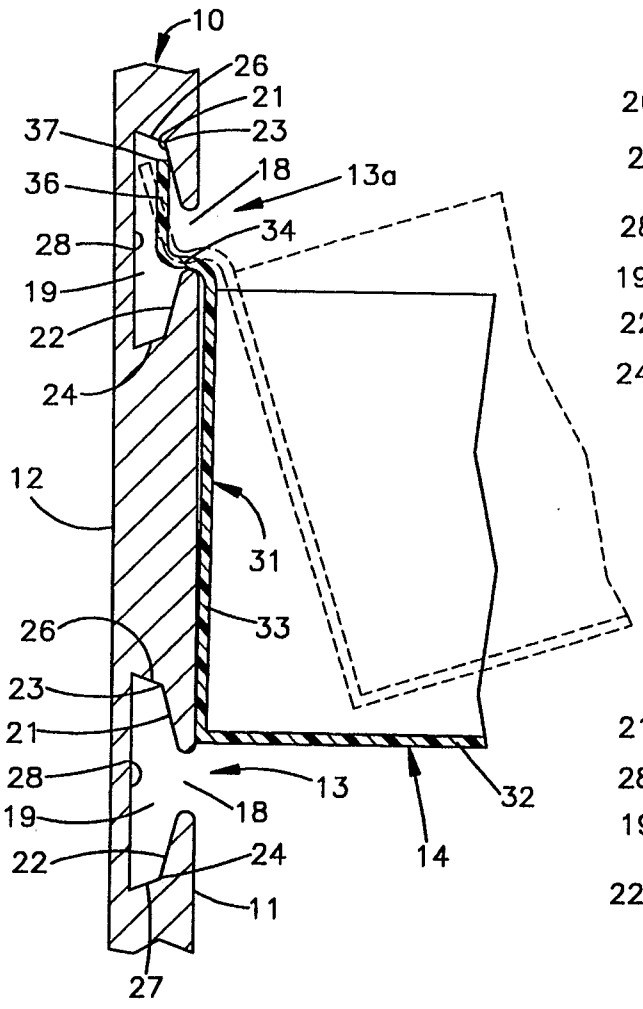
FIG. 3 is an enlarged fragmentary view better illustrating the slot shape and illustrating the manner in which one typical type of bracket is installed.

FIGS. 3–5 best illustrate the shape of the T-shaped slots 13, in accordance with this invention, and the manners in which the brackets are installed thereon. Each of the slots 13 includes a throat 18 open to the front face 11 of the panel 10. Behind the throat, the slot provides a vertically extending elongated opening 19 which cooperates with the throat to provide the T-shape to the slot. The opening 19 is bounded on the forward side by a pair of opposed substantially planar angulated surfaces 21 and 22. These two surfaces join at their inner ends with the wall of the throat 18 and extend rearwardly at a shallow angle to extremities at 23 and 24 where they join with end walls 26 and 27, respectively. These end walls 26 and 27 extend rearwardly and join with the ends of a slot back or inner wall 28 extending parallel to and spaced from the rearward face 12 of the panel.

With this structure which includes angulated walls 21 and 22, a substantial clearance or depth is provided within the opening 19 adjacent to the throat to facilitate the installation of the brackets.

Referring to FIG. 3, the bracket 14 is provided with a mounting portion 31 and a cantilever portion 32. The mounting portion includes a lower portion 33 which extends along the front face 11 downwardly from the associated slot 13*a*. The mounting portion also includes a lateral offset portion 34 which joins the lower mounting portion 33 and an upper mounting portion 36.

When installed, as illustrated in full line in FIG. 3, the offset portion 34 of the bracket mounting portion 31 rests against the lower edge of the throat 18 and provides the vertical support for the bracket. The upper mounting portion 36 extends up along the angled surface 21 a substantial distance from the throat 18 and provides an upper end 37 which engages the angled surface 21 substantially adjacent to the extremity 23 thereof.

The engagement between the lower end of the lower mounting portion 33 and the front face 11 cooperates with the engagement of the upper end of the upper mounting portion 36 with the angled surface 21 to provide a force couple which resists the force moment applied to the bracket by articles supported by the cantilever portion 32.

Because the slot is provided with angled surfaces 21 and 22 which extend from a relatively thin section adjacent to the throat 18, the slot is provided with ample clearance adjacent to the throat for ease of installation and removal of the brackets, as illustrated in phantom in the three FIGS. 3–5. However, the engagement of the end 37 with the angled wall 21 occurs at a location where substantial wall thickness exists to provide substantial strength for the support of the bracket 14. In the illustrated embodiment, the panel is $\frac{1}{2}$ inch thick, the throat 18 is about 11/32 of an inch wide and has an inner extremity spaced from the back wall 28 by about $\frac{1}{4}$ of an inch.

The back wall 28 is spaced from the rearward face by about $\frac{1}{8}$ of an inch, so the depth of the lips of the throat is about $\frac{1}{8}$ of an inch. The extremities 23 and 24 of the angulated surfaces are about 3/16 of an inch from the front face and are spaced horizontally from the back wall 28 by about 3/16 of an inch. Therefore, the groove has substantial depth adjacent to its upper and lower extremities to accept brackets with relatively thick upper mounting portions while still providing substantial strength to resist the load applied to the cantilever portion of the bracket. In the preferred embodiment, the vertical height of the opening 19 is about $1\frac{1}{4}$ inches.

Since the thickness of the panel material between the end 37 of the bracket mounting portions is less than $\frac{1}{4}$ inch, the lower mounting portion 33 is spaced from the front face 11 adjacent the associated throat 18 and only engages the front face 11 at a location spaced from the associated throat 18. This results in an increased moment arm of the force couple resisting loads and results in increased strength.

FIG. 4 illustrates the mounting of a cantilever bracket of the type originally designed for use with peg board. Such brackets are usually formed of rod material which tends to be relatively thick. In referring to the brackets 16 illustrated in FIG. 4, similar reference numerals will be used to refer to corresponding portions of the bracket 14 illustrated in FIG. 3. However, a prime (') will be added to indicate reference to the brackets 16 illustrated in FIG. 4.

Here again, the bracket is provided with a mounting portion 31' having a lower mounting portion 33', an offset portion 34', and an upper portion 36' extending to an end 37'. Extending outwardly from the mounting portion is the cantilever portion 32'. As illustrated in phantom, sufficient clearance is provided adjacent to the throat to allow the insertion of the upper portion 36', which upon reaching the installed position, extends up along the opening 19 to a location substantially spaced from the associated throat. At such location, the material adjacent to the end 37' is relatively thick. Here again, the lower portion engages the front face 11 at a location spaced from and below the associated throat 18.

FIG. 5 illustrates the installation of the brackets 17. Here again, corresponding portions of the bracket 17 will be referred to with reference numerals which are similar to the corresponding reference numerals in the bracket 14 of FIG. 3, but a double prime (") is added to indicate reference to the brackets 17.

Here again, the bracket is provided with a mounting portion 31″ having a lower mounting portion 33″, an offset 34″, and an upper mounting portion 36″ extending to an end 37″. The cantilever portion 32″ extends forwardly from the mounting portion 31″. It should be again noted that since the brackets 14 and 17 are initially constructed for installation on conventional ¾ inch thick display panels, the offset between the rearward surface of the lower mounting portion 33″ and the forward face of the upper mounting portion 36″ is ¼ of an inch. Since this is greater than the spacing between the engaged portion of the angulated surface 21 and the front wall 11, these brackets extend forwardly from the front wall a small distance adjacent to the throat 18, causing the engagement between the lower mounting portion and the front wall to tend to occur at the lower extremity of the lower portion.

In actual tests performed on panels having slots shaped as detailed above, it was found that the safe load carrying capacity of a given bracket installed in a half-inch thick panel, in accordance with the present invention, provided a load capacity equal to at least about 60 percent of the load capacity of a conventional ¾ inch slotted panel formed of the same material and having the same bracket installed therein.

Since the half-inch panel has a weight equal to 60 percent of the weight of a ¾ inch panel formed of the same material, it has been established that a panel in accordance with the present invention can be used with conventional brackets with equal material efficiency when considering weight and thickness. Therefore, a panel in accordance with the present invention is highly desirable for use where lighter loads will be applied to the installed brackets since substantial material cost savings are achieved and substantial shipping cost savings are also achieved. Further, when higher load capacity is desired, brackets can be selected having greater height and width in the mounting portion.

Although the preferred embodiment of this invention has been shown and described, it should be understood that various modifications and rearrangements of the parts may be resorted to without departing from the scope of the invention as disclosed and claimed herein.

What is claimed is:

1. A slotted display wall comprising a panel formed of material having horizontally extending vertically spaced slots constructed to allow the installation of cantilever brackets for support of articles, said panel having a predetermined thickness and parallel front and back substantially planar faces, said horizontally extending slots having a modified "T" shape open through said front face, said slots each having a throat open to said front face and extending a depth toward said back face to an inner end, the inner end of said throat joining opposed planar angled walls, said angled walls diverging from said throat in opposite directions to opposed extremities and being angled toward said back face, said throat depth being substantially less than the length of said angled wall, said angled walls increasing in thickness from substantially said throat to substantially said opposed extremities, a slot end wall joining said extremities of said angled walls and extending therefrom toward said back face, said end wall joining an inner slot wall spaced from and parallel to said panel back face.

2. A display wall as set forth in claim 1, wherein said end walls diverge as they extend from the associated of said angled walls toward said inner slot wall.

3. A display wall as set forth in claim 2, wherein said panel is substantially ½ inch thick, said inner slot wall is substantially ⅛ of an inch from said back face, and said throat extends about ⅛ of an inch back from said front face.

4. A bracket and slotted display wall panel formed of material having horizontally extending slots constructed to allow the installation of cantilever brackets for support of articles comprising a panel having a predetermined thickness and parallel front and back substantially planar faces, a plurality of horizontally extending slots having a modified "T" shape open through said front face, said slots each having a throat open to said front face including upper and lower sides extending a depth towards said back face to an inner end, the inner end of said throat joining opposed planar angled walls, said angled walls diverging from said throat in opposite directions to opposed extremities and being angled towards said back face, said throat depth being substantially less than the length of said angled wall, said angled walls increasing in thickness from substantially said throat to substantially said opposed extremities, a slot end wall joining said extremities of said angled walls and extending therefrom toward said back face, said end walls joining an inner slot wall spaced from and parallel to said panel back face, said bracket including a cantilever portion and a mounting structure including:

(a) an offset portion engageable with the lower side of said throat to vertically support said bracket;

(b) a lower portion engageable with said front face of said panel below the associated of such slots; and (c) an upper portion extending to an end engageable with the upper of said opposed planar angulated walls at a location substantially spaced from said throat where the material thickness between said location and front face is substantially greater than the material thickness at said throat, engagement between said end of said upper portion resisting forward movement of the upper end of said bracket mounting structure and cooperating with the engagement between the lower portion of said bracket mounting structure to maintain a fixed angle of said bracket relative to said front planar face.

5. A bracket and display wall panel as set forth in claim 4, wherein said panel is substantially ½ inch thick, said wall is substantially ⅛ inch from said back face, and said throat extends about ⅛ of an inch back from said front face.

6. A bracket and slotted display wall panel as set forth in claim 5, wherein said extremities of said angled walls are about 3/16 of an inch from said front face.

7. A bracket and slotted display wall panel as set forth in claim 4, wherein when said bracket is installed on said panel, said lower portion of said mounting structure is spaced forward from said front face adjacent to the associated throat and engages the front face at a location substantially spaced from the associated throat.

8. In combination, a slotted display wall panel and a cantilever bracket mounted thereon, said combination comprising a wall panel formed of a material having horizontally extending slots constructed to allow the installation of said cantilever brackets for supporting articles, said panel having a predetermined thickness and parallel front and back substantially planar faces, a plurality of horizontally extending vertically spaced slots having a modified "T" shape, said slots each having a throat open to said front face including upper and lower sides extending a depth toward said back face to an inner end, the inner end of said throat joining opposed planar angled walls, said angled walls diverging from said throat in opposite directions to opposed extremities and being angled toward said back face, said throat depth being substantially less than the length of said angled wall, said angled walls increasing in thickness from substantially said throat to substantially said opposed extremities, a slot end wall joining said extremities of each of said angled walls and extending therefrom toward said back face, said end walls joining an inner slot wall spaced from and parallel to said panel back face, said bracket including a cantilever portion and a mounting structure, said mounting structure including:

(a) an offset portion engaging said lower side of said throat to vertically support said bracket;

(b) a lower portion spaced from said front face adjacent to the associated of said throats and engaging said front face at a location spaced below the associated of said throats; and (c) an upper portion extending to an end engaging the upper of said opposed planar angulated walls at a location substantially spaced from said associated throat where the material thickness between said location and front face is substantially greater than the material thickness at said throat.

9. A display wall as set forth in claim 1, wherein each planar wall is formed in a single plane and uniformly increases in thickness from substantially said throat to substantially said opposed extremities.

10. A bracket and display wall panel as set forth in claim 4, wherein each planar wall is formed in a single plane and uniformly increases in thickness from substantially said throat to substantially said opposed extremities.

* * * * *